US011108203B2

(12) United States Patent
Beck

(10) Patent No.: US 11,108,203 B2
(45) Date of Patent: Aug. 31, 2021

(54) ELECTRICAL CONTACT FOR A PLUG CONNECTOR, HAVING ROTATABLE ROLLING CONTACT BODIES, AND ELECTRICAL PLUG-IN CONNECTION WITH SUCH A CONTACT

(71) Applicant: TE Connectivity Germany GmbH, Bensheim (DE)

(72) Inventor: Karl Beck, Langen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/352,985

(22) Filed: Mar. 14, 2019

(65) Prior Publication Data

US 2019/0214779 A1 Jul. 11, 2019

Related U.S. Application Data

(63) Continuation of application No. PCT/EP2017/073303, filed on Sep. 15, 2017.

(30) Foreign Application Priority Data

Sep. 15, 2016 (DE) ..... 102016217673.0

(51) Int. Cl.

| | |
|---|---|
| ***H01R 39/64*** | (2006.01) |
| ***H01R 24/58*** | (2011.01) |
| ***H01R 13/11*** | (2006.01) |
| ***H01R 13/20*** | (2006.01) |
| ***H01R 13/24*** | (2006.01) |
| *H01R 24/38* | (2011.01) |

(52) U.S. Cl.

CPC ..... *H01R 39/643* (2013.01); *H01R 13/11* (2013.01); *H01R 13/20* (2013.01); *H01R 13/24* (2013.01); *H01R 24/58* (2013.01); *H01R 24/38* (2013.01)

(58) Field of Classification Search

CPC ..... H01R 39/643; H01R 13/20; H01R 13/24; H01R 13/11; H01R 24/58; H01R 24/38

USPC ..... 439/11, 843

See application file for complete search history.

(56) References Cited

U.S. PATENT DOCUMENTS 2,716,737 A * 8/1955 Maberry ..... H01R 13/28 439/176
3,885,087 A * 5/1975 Takada ..... H02G 15/003 174/93
3,903,595 A * 9/1975 Takada ..... H02G 15/003 29/870
4,550,972 A * 11/1985 Romak ..... H01R 13/111 439/839

(Continued)

FOREIGN PATENT DOCUMENTS

DE 230107 A1 11/1985
DE 4138813 A1 5/1993

(Continued)

OTHER PUBLICATIONS

German Office Action, dated Jul. 31, 2017, 6 pages.

(Continued)

*Primary Examiner* — Harshad C Patel
(74) *Attorney, Agent, or Firm* — Barley Snyder

(57) ABSTRACT

An electrical contact has a contact surface adapted to contact a mating contact. The contact surface has a plurality of rotatable rolling contact bodies made of an electrically conductive material.

20 Claims, 5 Drawing Sheets

(56) References Cited

U.S. PATENT DOCUMENTS

| | | | | |
|---|---|---|---|---|
| 4,696,531 | A * | 9/1987 | Bohme | H01R 13/111 439/851 |
| 5,381,782 | A * | 1/1995 | DeLaRama | A61B 1/0056 138/118 |
| 6,062,919 | A * | 5/2000 | Trafton | H01R 13/187 439/843 |
| 6,254,439 | B1 * | 7/2001 | Endo | H01R 13/187 439/843 |
| 7,108,514 | B2 * | 9/2006 | Chen | H01R 13/648 439/63 |
| 7,387,548 | B2 * | 6/2008 | Takehara | H01R 13/187 439/843 |
| 7,682,206 | B2 * | 3/2010 | Kainz | H01R 13/187 439/700 |
| 7,805,838 | B2 * | 10/2010 | Morana | H01R 13/187 29/868 |
| 8,162,672 | B2 * | 4/2012 | Huang | H01R 13/11 439/580 |
| 9,300,870 | B2 | 3/2016 | Aono et al. | |
| 9,496,638 | B1 * | 11/2016 | Su | H01R 4/363 |
| 9,917,390 | B1 * | 3/2018 | Bianca | H01R 13/187 |
| 2011/0059638 | A1 * | 3/2011 | Sandwith | H01R 13/521 439/271 |
| 2013/0197603 | A1 | 8/2013 | Eiger | |
| 2014/0357137 | A1 * | 12/2014 | Sian | H01R 13/187 439/843 |
| 2015/0222037 | A1 | 8/2015 | Bulmer et al. | |
| 2015/0256751 | A1 | 9/2015 | Aono et al. | |
| 2016/0211590 | A1 * | 7/2016 | Saur | H01R 4/48 |

FOREIGN PATENT DOCUMENTS

| | | | |
|---|---|---|---|
| DE | 102009046928 | A1 | 5/2011 |
| DE | 102009054825 | A1 | 6/2011 |
| GB | 1242297 | | 8/1971 |
| JP | S4712001 | | 1/1947 |
| JP | 07037636 | A | 2/1995 |
| JP | 2000299172 | A | 10/2000 |
| JP | 2011222463 | A | 11/2011 |
| JP | 2015011963 | A | 1/2015 |
| JP | WO 2015002159 | * | 1/2015 |
| JP | 2019535981 | | 3/2019 |

OTHER PUBLICATIONS

Abstract of corresponding document EP2337156, related to DE102009054825, dated Jun. 22, 2011, 1 page.
Abstract of DE102009046928, dated May 26, 2011, 1 page.
PCT Written Opinion of the International Searching Authority and International Search Report, Intl Appl. No. PCT/EP2017/073303, dated Oct. 19, 2017, 10 pages.
Abstract of DE4138813, dated May 27, 1993, 1 page.
Abstract of JP2011222463(A) , dated Nov. 4, 2011, 1 page.
Notice for Reasons for Refusal, dated Mar. 31, 2020, 10 pages.
Abstract of JP2000299172, dated Oct. 24, 2000, 1 page.
Summary of Office Action dated Aug. 31, 2020 from the Korean Patent Office and English translation thereof. 9pp.
Chinese Second Office Action and English translation, dated Nov. 17, 2020, Application No. 201780056690.4, 17 pages.

* cited by examiner

ELECTRICAL CONTACT FOR A PLUG CONNECTOR, HAVING ROTATABLE ROLLING CONTACT BODIES, AND ELECTRICAL PLUG-IN CONNECTION WITH SUCH A CONTACT

CROSS-REFERENCE TO RELATED APPLICATIONS

This application is a continuation of PCT International Application No. PCT/EP2017/073303, filed on Sep. 15, 2017, which claims priority under 35 U.S.C. § 119 to German Patent Application No. 102016217673.0, filed on Sep. 15, 2016.

FIELD OF THE INVENTION

The present invention relates to a plug connector and, more particularly, to an electrical contact for a plug connector.

BACKGROUND

A pair of matable electrical contacts may be mutually complementary bushing contacts and pin contacts. The pins can be peg-shaped or tab-shaped. For such contacts, it is important that a stable contacting of the mating contacts takes place, and in particular, it is important that the contact resistance remains stable. This is achieved by high contact forces, i.e. high forces which press the contacts together at their contact surfaces.

In order to break through highly resistive corrosion layers and impurity layers, the contact surface should be as small as possible so that the contact force achieves a high surface pressure. On the other hand, the contact surface must not be too small, as otherwise the contact resistance becomes too great when high currents flow, even with broken-through corrosion layers and impurity layers. In the case of large plugs, the two contacts can only be mated by exerting high plug-in forces. If the contacts connected to cables are then in a vibration-loaded environment, there is risk of a cable break due to the relative movement between the cables and the contacts.

SUMMARY

An electrical contact has a contact surface adapted to contact a mating contact. The contact surface has a plurality of rotatable rolling contact bodies made of an electrically conductive material.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
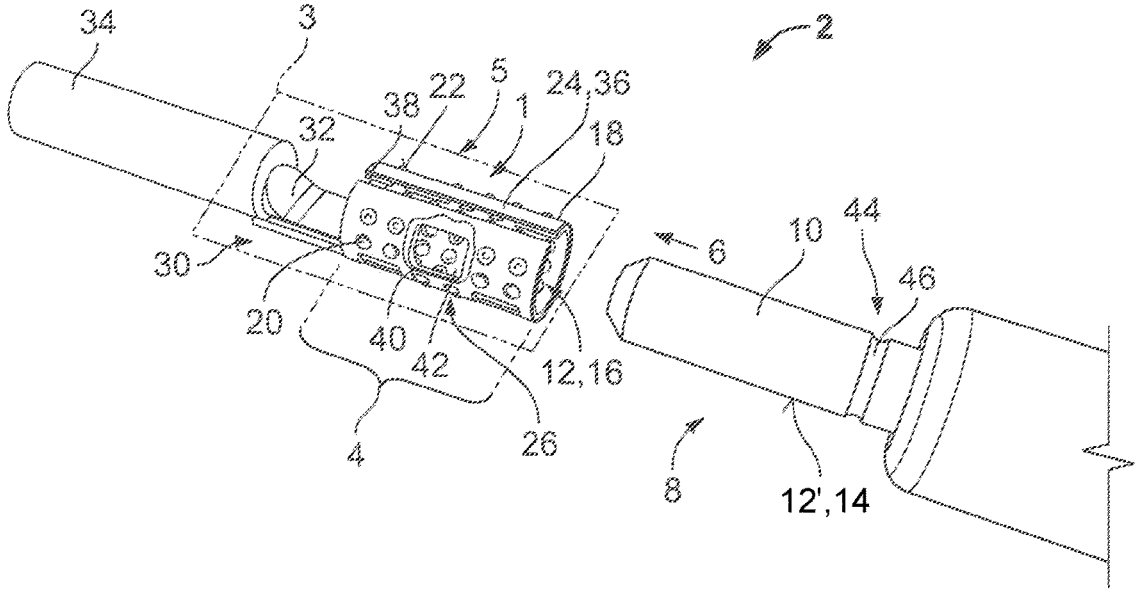
FIG. 1 is a perspective view of an electrical contact according to an embodiment with a mating contact.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

Figure 2:
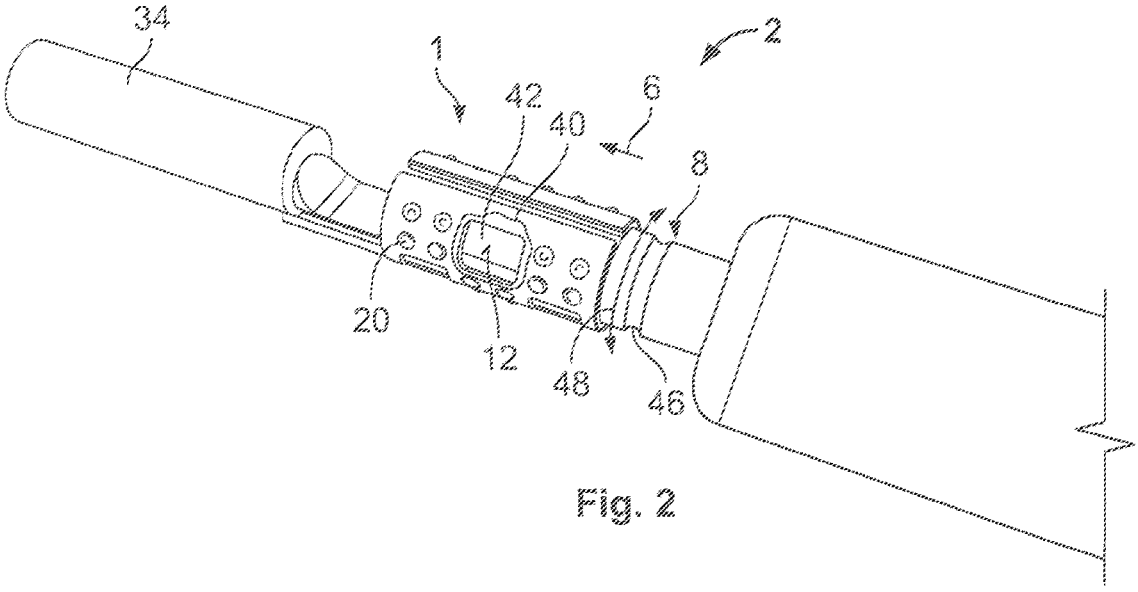
FIG. 2 is a perspective view of the electrical contact and the mating contact in a mated state.

An electrical contact 1 according to an embodiment is shown in FIGS. 1 and 2. In the shown embodiment, the electrical contact 1 is part of a plug connector 3. The electrical contact 1 has a sleeve-shaped contact area 4 into which a mating contact 8, a peg-shaped pin contact 10 in the shown embodiment, can be inserted in a plug-in direction 6 to form a plug electrical connection 2. In other embodiments, the pin contact 10 can be tab-shaped, which requires a corresponding complementary configured sleeve-shaped contact area 5.

When the electrical contact 1 and the mating contact 8 are mated in the plug-in direction 6, as shown in FIG. 2, their contact surfaces 12, 12' contact one another. The contact surface 12' of the pin contact 10 is an outwardly facing outer surface 14. The contact surface 12 of the electrical contact 1 is an inwardly facing inner surface 16. In a mated state shown in FIG. 2, the contacts 1, 8 are aligned coaxially to the plug-in direction 6.

As shown in FIGS. 1 and 2, at least one of the contact surfaces 12, 12' has a plurality of rotatable rolling contact bodies 20 which are manufactured from an electrically conductive material. In an embodiment, the rotatable rolling contact bodies 20 are formed from an electrically conductive material with a conductivity of at least 30 S/m. In an embodiment, the rolling contact bodies 20 contain at least one of the following metals: gold, silver, aluminum and/or copper. In the embodiment shown in FIGS. 1 and 2, the rolling contact bodies 20 are spherical merely by way of example. In other embodiments, conical, truncated cone-shaped, barrel-shaped, needle-shaped and/or cylindrical rolling contact bodies 20 can be used. The rolling contact bodies 20 have a diameter of between 0.5 mm and 2 mm, and in another embodiment, have a diameter of less than 5 mm.

In the shown embodiment, the contact surface 12 of the electrical contact 1 has the rolling contact bodies 20. In another embodiment, the rolling contact bodies 20 can be disposed at the pin contact 10. The contact surface 12, 12' of the contact 1, 8 which has the rolling contact bodies 20 consists exclusively of a plurality of surfaces 22 of the rolling contact bodies 20. The rolling contact bodies 20 protrude somewhat from the contact 1, 8; inwardly in the case of the electrical contact 1, and outwardly in the case of the pin-shaped contact 8 with rolling contact bodies 20.

Figure 4:
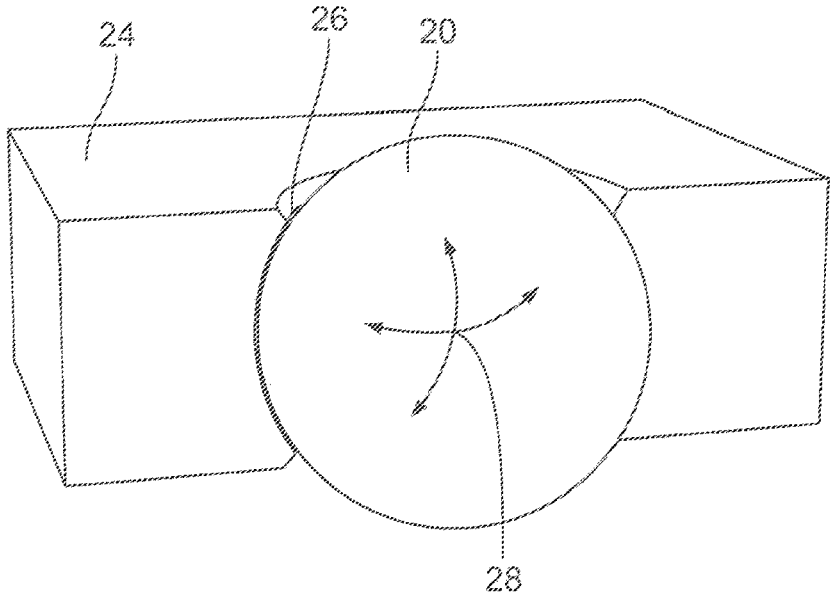
FIG. 4 is a perspective view of a rolling contact body in a rolling body cage of the electrical contact.

The rolling contact bodies 20 are rotatably held by a rolling body cage 24, as shown in FIG. 1. The rolling body cage 24 has a plurality of openings 26 in which the rolling contact bodies 20 are inserted, as schematically shown in FIG. 4. A section of the rolling contact body 20 is positively held in the rolling body cage 24 and, in the case of the depicted spherical rolling contact body 20, is rotatable in every direction as indicated by the arrows 28. In other embodiments, a conical, truncated cone-shaped, barrel-shaped, needle-shaped and/or cylindrical rolling contact body 20 would, however, only be rotatable about one individual rotation axis. As shown in FIG. 4, the rolling contact body 20 projects at least on one side, and in the shown embodiment on both sides, beyond the rolling body cage 24.

As shown in FIGS. 1 and 2, the rolling body cage 24 integrally forms an attachment section 30 to which, for example, a conductor 32 of a cable 34 can be attached. In various embodiments, the attachment section 30 can be a crimping section and/or can have a section for a cohesive connection such as, for example, soldering. The attachment section 30 can also attach the electrical contact 1 in a plug housing with further electrical contacts 1. In the embodiment of FIGS. 1 and 2, the rolling body cage 24 is a spring sleeve 36 which is resiliently stretchable or compressible in the direction transverse to the plug-in direction 6. In an embodiment, the spring sleeve 36 is preloaded. The rolling body cage 24 has a gap 38 which in the plug-in direction 6 can pass through the entire rolling body cage 24 or can be divided by material bridges.

The rolling body cage 24, as shown in FIGS. 1 and 2, can have one or more weakened areas 40 in which the compliance is increased. The weakened areas 40 can be arranged between individual rolling contact bodies 20 or between groups of rolling contact bodies 20. In an embodiment, a weakened area 40 can have a recess 42. The sleeve-shaped rolling body cage 24 can adapt to shape tolerances with the weakened areas 40, wherein the deformation focuses on the weakened areas 40 such that the area around the rolling contact bodies 20 can be configured rigidly. The increased rigidity around the rolling contact bodies 20 prevents the rolling contact bodies 20 from being able to jam in the openings 26 in the event of deformation of the rolling body cage 24. In addition, the flexible configuration of the rolling body cage 24 permits an even distribution of the contact force onto the rolling contact bodies 20.

When the two contacts 1, 8 are mated, in the embodiment shown in FIGS. 1 and 2, the rolling contact bodies 20 of the electrical contact 1 roll on the contact surface 12' of the pin contact 10. The rolling contact bodies 20 form a rolling bearing which at high contact pressure enables a smooth movement between the contacts 1, 8. The spring sleeve 36 and the rolling body cage 24 are resiliently deformed in the mated state, here stretched, such that a contact force is exerted on the rolling contact bodies 20. By virtue of the small contact surface 22, formed by the plurality of individual rolling contact bodies 20, a high surface pressure arises which breaks through the corrosion layers or impurity layers and produces a secure electrical contact between the contacts 1, 8. Despite a high contact pressure, the plug-in connection 2 can be plugged with only a small exertion of force because the rolling contact bodies 20 do not slide on the contact surface 12', but instead roll.

In an embodiment, the rolling body cage 24 is made of an electrically non-conductive material, and the current can be tapped from the rolling contact bodies 20 from the contact surface 12 at the side of the rolling body cage 24 opposite the contact surface 12' of conductive material, which touches the rolling contact bodies 20. In another embodiment, the rolling body cage 24 can be manufactured from a conductive substance, for example a substance such as is specified above for the rolling contact bodies 20. In this case, the current can be transmitted by the rolling body cage 24. The inner or outer cross-section of the carrier 51 and/or the rolling body cage 24 can be round, circular and/or polygonal.

A locking connection 44 between the contacts 1, 8, shown in FIG. 1, can secure the connection 2 while maintaining mobility between the contacts 1, 8. A rotatable but axially secured locking connection 44 can, in an embodiment, be formed by a groove 46, circumferential to the plug-in direction 6, in the mating contact 8, in which one or more rolling contact bodies 20 engage upon the two contacts 1, 8 achieving a complete plugging. When using spherical rolling contact bodies 20, the mated plug-in connection 2 permits a relative rotation 48 of the contacts 1, 8 about the plug-in direction 6. This avoids cable 34 breaks, for example, in vibration-loaded environments.

Figure 3:
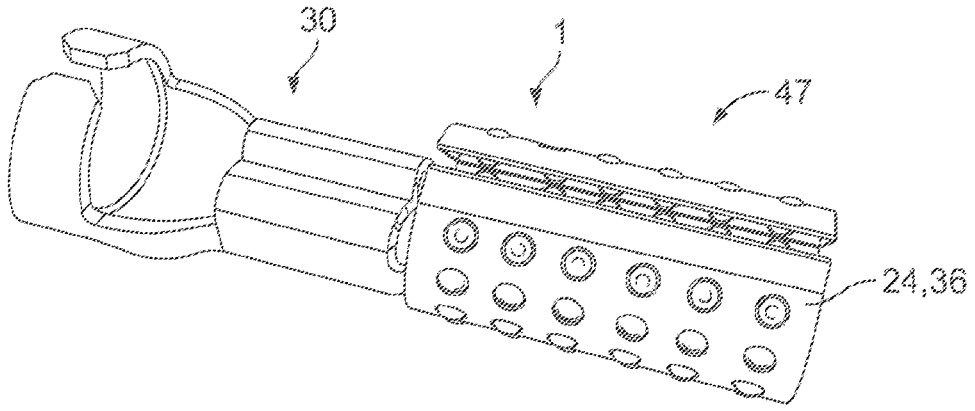
FIG. 3 is a perspective view of an electrical contact according to another embodiment.

In another embodiment of the electrical contact 1 shown in FIG. 3, the rolling body cage 24 is configured integrally with the attachment section 30 for crimping the conductor 32. The electrical contact 1 can therefore be a crimp contact 47. In contrast to the embodiment of FIGS. 1 and 2, the rolling body cage 24 has no weakened areas 40 but nevertheless acts as a spring sleeve 36.

Figure 5:
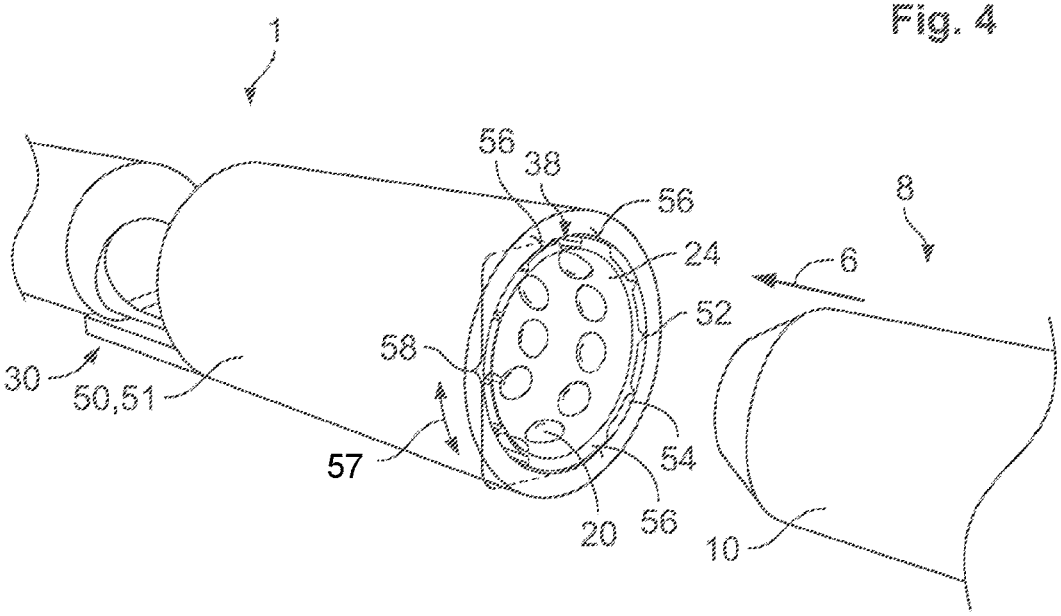
FIG. 5 is a perspective view of an electrical contact according to another embodiment with the mating contact.

The electrical contacts 1 or their rolling body cages 24 of the embodiments of FIGS. 1-3 are manufactured from a stamped bent part and are one piece. A multi-part electrical contact 1, with the rolling body cage 24 received by a carrier 51 which is configured as a housing 50, is shown in the embodiment of FIG. 5. The electrical contact 1 with the rolling contact bodies 20 is here too only depicted as a contact sleeve by way of example; the rolling body cage 24 can also be attached to the pin contact 10 as a carrier.

As shown in FIG. 5, the housing 50 surrounds the rolling body cage 24, is sleeve-shaped, and integrally forms the attachment section 30. In the embodiment of FIG. 5, the rolling body cage 24 is produced from a non-conductive material such as, for example, a plastic, and can be formed by injection molding. Spacers 52 can be arranged between the carrier 51 and the rolling body cage 24. The spacers 52 can be formed on the carrier 51 and/or on the rolling body cage 24 or as separate parts; in the embodiment of FIG. 5, the spacers 52 are monolithic components of the rolling body cage 24. The rolling contact bodies 20 are held spaced apart from the carrier 51 by the spacers 52. The rolling contact bodies 20 can thereby rotate freely without rolling on the housing 50, in particular on its inner surface 54. The rolling body cage 24 can thereby remain stationary in the housing 50 upon insertion of the mating contact 8 into the contact 1.

The spacers 52 can be compressible transverse to the plug-in direction 6 such that, upon insertion of the mating contact 8, the rolling body cage 24 can resiliently stretch and exert a contact force onto the rolling contact bodies 20. Alternatively or additionally, the rolling body cage 24 can bear against support points 56 on the carrier 51. The support points 56 are spaced apart from one another in a circumferential direction 57 about the plug-in direction 6, and can be spaced apart from the housing 50 in a plurality of intermediate areas 58. The spacers 52 can be arranged in the intermediate areas 58. In this way, upon insertion of the mating contact 8, the rolling body cage 24 can stretch until the spacers 52 abut against the carrier 51.

In an embodiment, the rolling body cage 24 is made of a non-conductive material and the carrier 51 is made of an electrically conductive material. The rolling contact bodies 20 contact the carrier 51 and the carrier 51 transmits the current received by the rolling contact bodies 20 from the contact surface 12'. The carrier 51 can be sleeve-shaped or pin-shaped, depending on whether the contact 1, 8 having the rolling contact bodies 20 is a male or a female contact.

Figure 6:
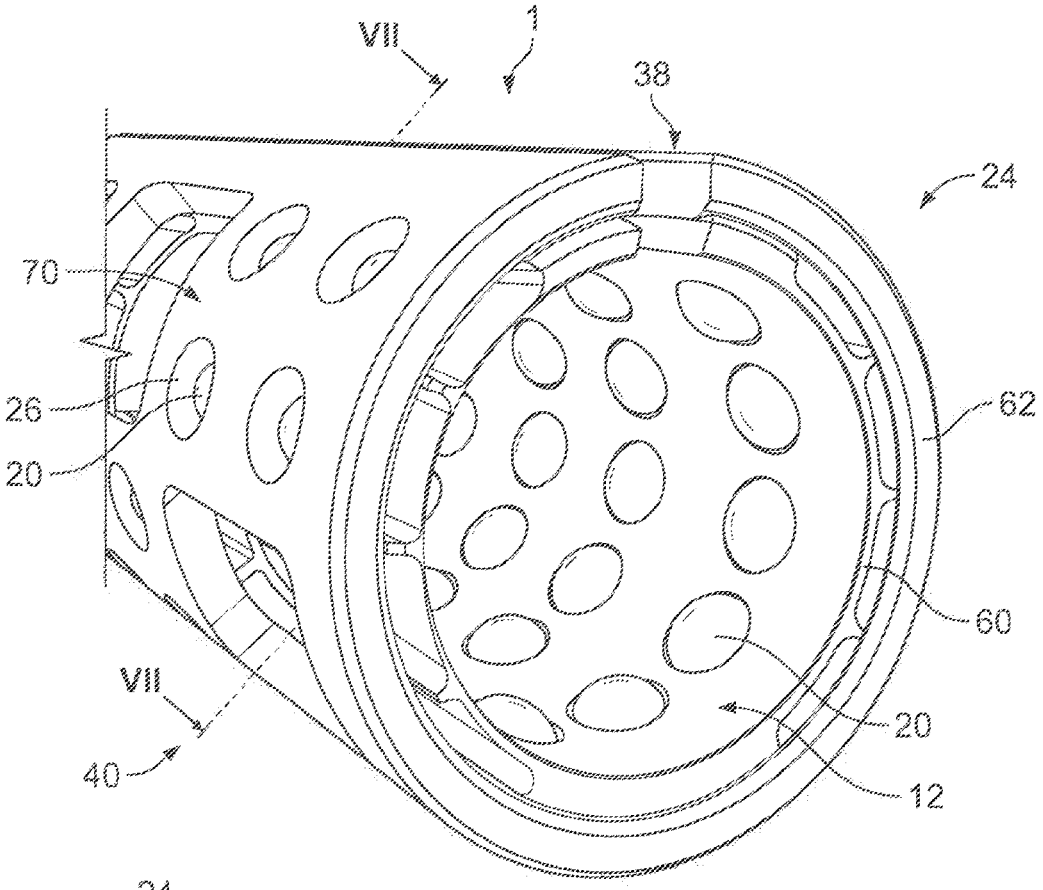
FIG. 6 is a perspective view of an electrical contact according to another embodiment.
Figure 7:
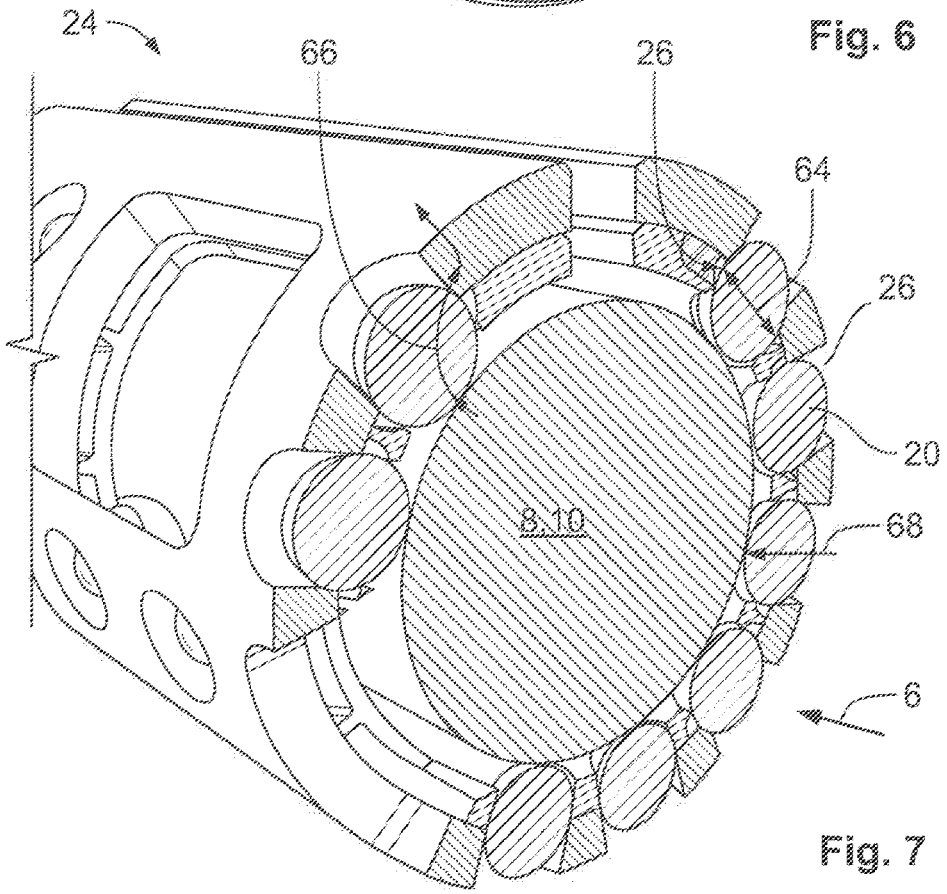
FIG. 7 is a sectional perspective view of the electrical contact, taken along line VII-VII of FIG. 6.

In other embodiments, the rolling body cage 24 can be configured in multiple parts, as shown in FIGS. 6 and 7, with an inner part 60 and an outer part 62. The rolling contact bodies 20 are rotatably held between the inner part 60 and the outer part 62. In this embodiment, the rolling contact bodies 20 only project beyond the rolling body cage 24 on the side of the contact surface 12. The openings 26 can be disposed both in the inner part 60 and the outer part 62; the openings 26 are aligned for aligning the rolling contact bodies 20 with one another. A section 64 of the rolling contact bodies 20 with the largest diameter is located between the inner part 60 and the outer part 62, which diameter is in each case larger than the inner width of the openings 26 in the inner part 60 and the outer part 62. The rolling contact bodies 20 are thus positively held between inner part 60 and outer part 62.

Upon insertion of the mating contact 8, the rolling body cage 24 is resiliently deformed and stretched. This gives rise to a contact force 68 shown in FIG. 7 which impacts transversely to the plug-in direction 6 and which impacts on each rolling contact body 20.

The inner part 60 and/or the outer part 62 of the embodiment of FIGS. 6 and 7 are manufactured from a conductive material. The current path 66 runs from the mating contact 8, via the rolling contact bodies 20, via the conductive inner part 60 and/or outer part 62 to the conductor 32. The inner part 60, in an embodiment, is formed of plastic. Both parts 60, 62 can have the gap 38 and/or have weakened areas 40. The gaps 38 of the two parts 60, 62 can overlap.

Figure 8:
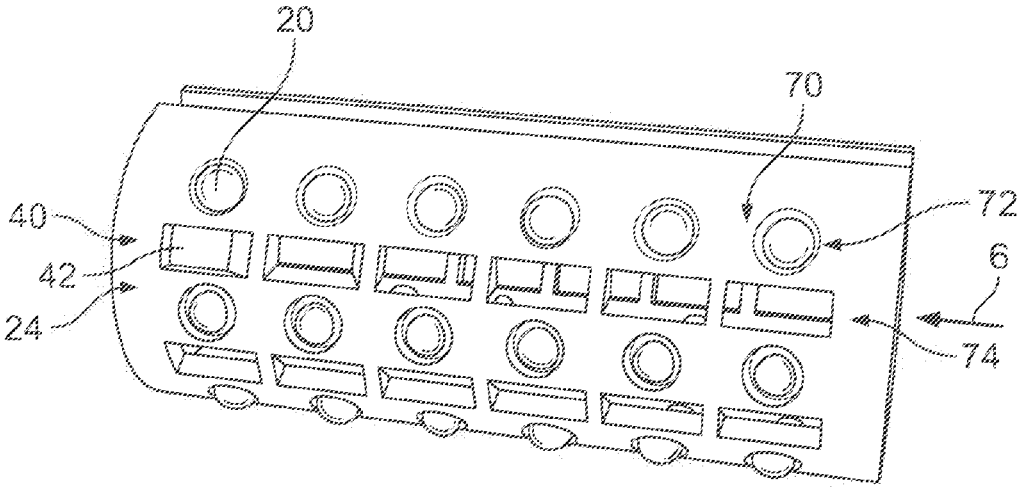
FIG. 8 is a perspective view of a rolling body cage according to an embodiment.

In the embodiment shown in FIG. 6, a group 70 of rolling contact bodies, here a group 70 of 2×2 rolling contact bodies 20 arranged on a rectangular base, is respectively separated from adjacent groups 70 in both the plug-in direction 6 and the direction about the plug-in direction 6. FIG. 8 shows an embodiment of the rolling body cage 24 in which the groups 70 of rolling contact bodies 20 form aligned rows 72 in the plug-in direction 6. The individual rows 72 are each separated by a weakened area 40 extending in plug-in direction 6 having a row 74 of recesses 42 which extend in plug-in direction 6. In this configuration, the rows 72 form rigid segments which are movably connected to one another in the direction about the plug-in direction 6 via the weakened areas 40. This ensures that all rolling contact bodies 20 can contact the mating plug 8.

Figure 9:
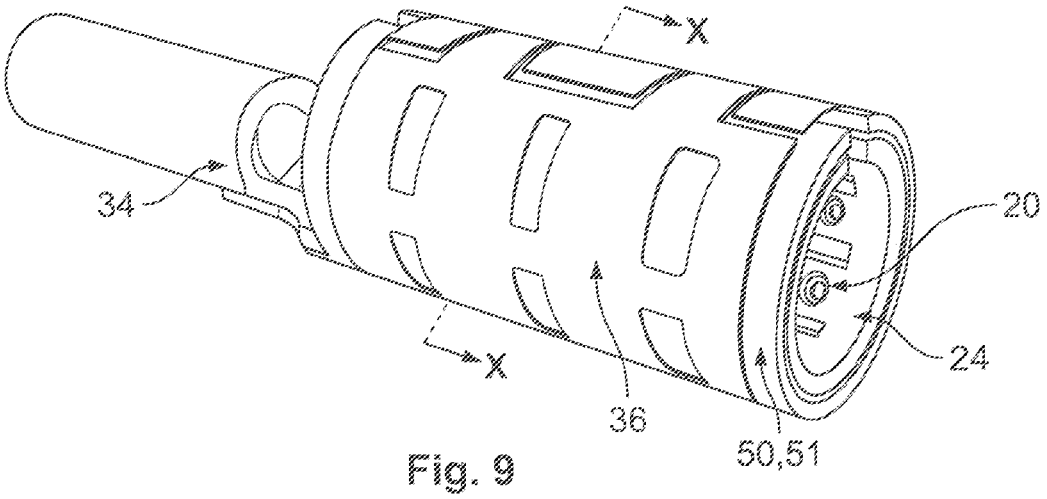
FIG. 9 is a perspective view of an electrical contact according to another embodiment.
Figure 10:
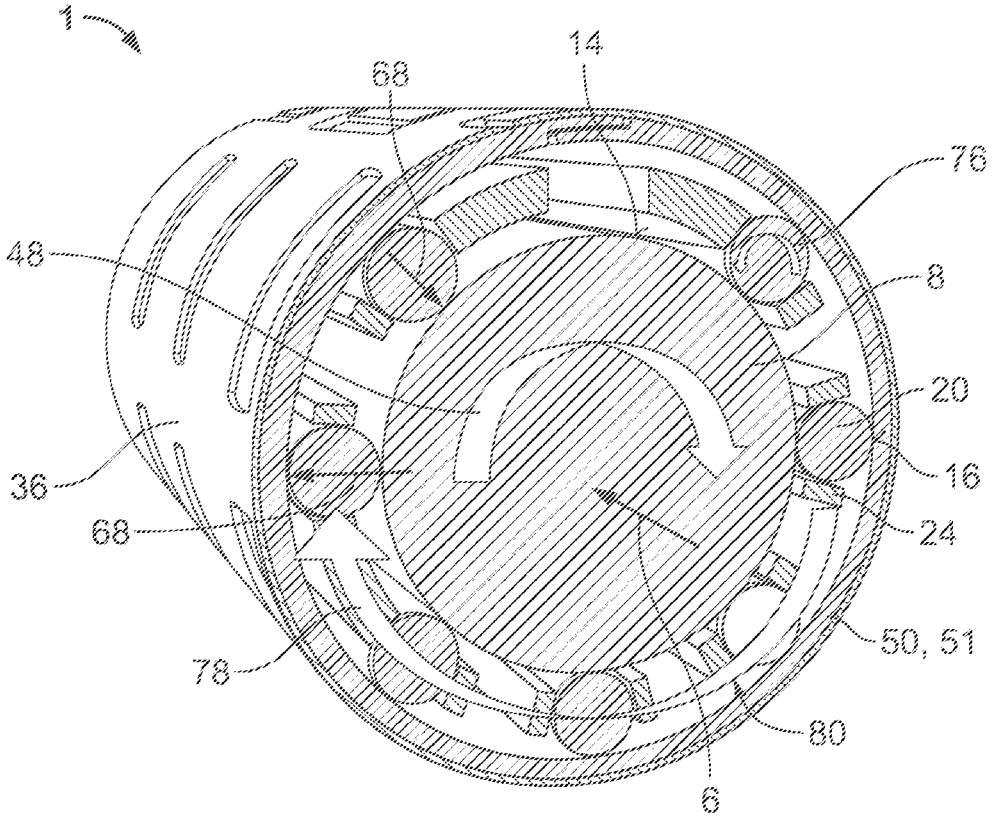
FIG. 10 is a sectional perspective view of the electrical contact, taken along line X-X of FIG. 9.

An embodiment in which the rolling body cage 24 is movably received in the electrical contact 1 is shown in FIGS. 9 and 10. The mobility is achieved by the rolling contact bodies 20 contacting the carrier 51 and being able to roll on it. A movement of the rolling body cage 24 is possible about the plug-in direction 6 as a rotation axis and/or along the plug-in direction 6 in a translatory manner.

In the case of a rotational movement 48 of the mating plug 8 about the plug-in direction 6, as shown in FIG. 10, the rolling contact bodies 20 roll on the outer surface 14 of the mating plug 8 and roll on the inner surface 16 of the carrier 51. The rolling movement of the rolling contact bodies 20 upon rotation 48 of the mating contact 8 is indicated in FIG. 10 by the arrow 76. The rolling of the rolling contact bodies 20 on the outer surface 14 and the inner surface 16 leads to a rotation 78 of the rolling body cage 24. In order to create sufficient contact forces 68 which guarantee a smooth rolling movement 76, a spring sleeve 36 is provided. In the embodiment of FIGS. 9 and 10, the spring sleeve 36 is a separate part which is assembled over the carrier 51.

If the rolling body cage 24 is held by the carrier 51 in a translatory manner along the plug-in direction 6, movable between two end positions and retained by a positive locking connection such as the locking connection 44, the rolling bearing cage 24 is thus moved with the mating contact 8 in the same direction by virtue of the rolling movement of the rolling contact bodies 20 upon withdrawal of the mating contact 8. Upon introduction of the mating contact 8, the rolling body cage 24 moves in the same direction as the mating contact 8. As a result, vibrational movements can also be compensated between the two end positions in the plug-in direction by a relative movement between the two contacts 1, 8. The rolling contact bodies 20 together with the rolling body cage 24 form a rolling bearing 80. The housing 50 or the carrier 51 can form the inner or outer running surface for the rolling contact bodies 20 on the contact surface 12 of the mating contact 8.

What is claimed is:

1. An electrical contact, comprising:

a contact surface adapted to contact a mating contact, the contact surface having a plurality of rotatable rolling contact bodies made of an electrically conductive material; and a rolling body cage having a plurality of openings in which the rotatable rolling contact bodies are disposed, widths of each of the plurality of openings defined on a first side and a second side of the opening are less than a width of the widest portion of the rotatable rolling contact body, the widest portion of the rotatable rolling contact body arranged in a middle of the opening between the first side and the second side of the opening such that the widest portion of the rotatable rolling contact body is positively held between the first side and the second side of the opening and within the rolling body cage only by the opening.

2. The electrical contact of claim 1, further comprising a carrier holding the rolling body cage.

3. The electrical contact of claim 2, wherein the carrier is made of an electrically conductive material and contacts the rotatable rolling contact bodies.

4. The electrical contact of claim 3, wherein the rotatable rolling contact bodies are held by the rolling body cage and are rollable with respect to the carrier.

5. The electrical contact of claim 2, further comprising a plurality of spacers disposed between an inner surface of the carrier facing the rolling body cage and an outer surface of the rolling body cage facing the inner surface of the carrier.

6. The electrical contact of claim 5, wherein the spacers space the rotatable rolling contact bodies apart from the carrier with the mating contact mated to the electrical contact.

7. The electrical contact of claim 6, wherein the spacers are compressible in a direction transverse to the plug-in direction.

8. The electrical contact of claim 1, wherein the rolling body cage has an unoccupied weakened area disposed between individual rotatable rolling contact bodies and/or disposed between a plurality of groups of rotatable rolling contact bodies.

9. The electrical contact of claim 8, wherein the rolling body cage is more compliant in the weakened area than in an area around the weakened area.

10. The electrical contact of claim 8, wherein the weakened area is a recess extending through the rolling body cage in a direction transverse to the plug-in direction, the recess comprising an unoccupied opening having profile distinct from the plurality of openings.

11. The electrical contact of claim 1, further comprising a sleeve-shaped housing surrounding the rolling body cage.

12. The electrical contact of claim 11, wherein the sleeve-shaped housing is a spring sleeve acting on the rolling body cage and generating a contact force on the rotatable rolling contact bodies.

13. The electrical contact of claim 1, wherein the rolling body cage forms a spring sleeve receiving a pin contact.

14. The electrical contact of claim 1, wherein each of the rotatable rolling contact bodies has a diameter smaller than a diameter of each of the openings.

15. The electrical contact of claim 1, wherein a center of the rotatable roller contact is arranged between the first side and the second side of the opening in the radially outward direction.

16. A plug electrical connection, comprising:

an electrical contact including a contact surface having a plurality of rotatable rolling contact bodies made of an electrically conductive material, a rolling body cage having a plurality of openings in which the rotatable rolling contact bodies are disposed, and an unoccupied weakened area disposed between individual rotatable rolling contact bodies and/or disposed between a plurality of groups of rotatable rolling contact bodies, the weakened area is a recess extending through the rolling body cage in a direction transverse to a plug-in direction, the recess comprising an unoccupied opening having profile distinct from the plurality of openings, each of the rotatable rolling contact bodies is captured within the rolling body cage by one of the plurality of openings, the rolling body cage has a gap extending through the rolling body cage in the plug-in direction and separating the rolling body cage in a circumferential direction about the plug-in direction; and a mating contact matable with the electrical contact in the plug-in direction, the contact surface of the plurality of rotatable rolling contact bodies forming an electrical connection between the electrical contact and the mating contact.

17. The plug electrical connection of claim 16, wherein the electrical contact is movable in a mated state with the mating contact relative to the mating contact via the rotatable rolling contact bodies rolling on the mating contact.

18. The plug electrical connection of claim 16, wherein the mating contact is rotatably held in the electrical contact about the plug-in direction.

19. The plug electrical connection of claim 16, further comprising:

a carrier holding the rolling body cage; and a plurality of spacers disposed between an inner side of the carrier and an outer side of the rolling body cage, wherein the rotatable rolling contact bodies are held spaced apart from the inner side of the carrier by the plurality of spacers with the mating contact mated with the electrical contact.

20. An electrical contact, comprising:

a contact surface adapted to contact a mating contact, the contact surface having a plurality of rotatable rolling contact bodies made of an electrically conductive material; and a rolling body cage having a plurality of openings in which the rotatable rolling contact bodies are disposed, each of the rotatable rolling contact bodies is positively held within the rolling body cage by one of the plurality of openings, with each of the plurality of openings of the rolling body cage sized to limit motion of each of the rotatable contact bodies in a direction radially outward from the rolling body cage and transverse to a direction of insertion, wherein widths of each of the plurality of openings defined on a first side and a second side of the opening are less than a width of the widest portion of the rotatable roller contact body, the widest portion of the rotatable rolling contact body arranged in a middle of the opening between the first side and the second side of the opening such that the widest portion of the rotatable rolling contact body is held between the first side and the second side of the opening and within the rolling body cage.

* * * * *